US005265835A

United States Patent [19]

Nash

[11] Patent Number: 5,265,835

[45] Date of Patent: Nov. 30, 1993

[54] MOVEABLE FOREARM SUPPORT

[76] Inventor: A. Richard Nash, 155 Bergenfield Dr., East Williston, N.Y. 11596

[21] Appl. No.: 868,006

[22] Filed: Apr. 13, 1992

[51] Int. Cl.[5] ..... B68G 5/00

[52] U.S. Cl. ..... 248/118; 248/118.5; 248/918

[58] Field of Search ..... 248/118, 118.3, 118.5, 248/918; 400/718; 340/700; 401/48

[56] References Cited

U.S. PATENT DOCUMENTS

| | | | |
|---|---|---|---|
| 1,627,635 | 5/1927 | Craig | 248/118.5 |
| 4,313,585 | 2/1982 | Bricker | 401/48 X |
| 4,545,554 | 10/1985 | Latino | 248/118.1 |
| 4,688,862 | 8/1987 | Fowler | 400/715 X |
| 4,913,390 | 4/1990 | Berke | 248/918 X |

FOREIGN PATENT DOCUMENTS

| | | | |
|---|---|---|---|
| 17243 | 3/1882 | Fed. Rep. of Germany | 248/118.5 |

*Primary Examiner*—J. Franklin Foss
*Attorney, Agent, or Firm*—Gerard F. Dunne

[57] ABSTRACT

A support for the forearm of a person actuating an object such as a computer mouse which can be slid along a horizontal surface includes a pad supported at a declination upon rolling elements. The forward portion of a person's arm is supported at the lower position of the pad, and the pad has a concave central portion rising upwardly at the lateral portions so that movement of the forearm can direct the position of the support.

2 Claims, 1 Drawing Sheet

MOVEABLE FOREARM SUPPORT

The present invention relates to a support for the forearm of a person who is actuating such objects as a computer mouse.

It has become increasingly common for computer operators, graphic artists and the like to actuate an object such as a computer mouse by sliding it horizontally about a surface. Continuous operation of such computer mice over a long period of time can be fatiguing. Accordingly, it is an object of the present invention to provide a forearm support which can be moveable easily by the user and supports the forearm in a position reducing fatigue during the extended manipulation of such items as computer mice.

According to the present invention, a support for the forearm of a person actuating an object slideable over a horizontal surface, such as a computer mouse, includes a pad supported at a declination upon rolling elements. In this way, the pad can receive the forward portion of the forearm of the person actuating the computer mouse at its lower end, and the pad has a concave central portion rising upwardly at its lateral portions so that lateral movement of the forearm of the user can easily direct such support to any desired position.

This and other objects, advantages and features of the present invention will become more readily apparent upon review of the detailed descriptions of a perferred embodiment made below in connection with the accompanying drawings, in which.

Figure 1:
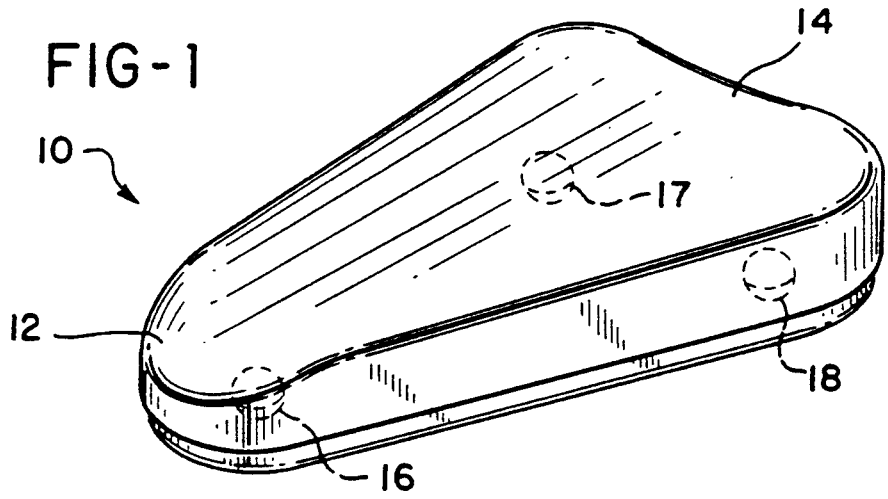
FIG. 1 is a perspective view of a moveable forearm support of the present invention.
Figure 2:
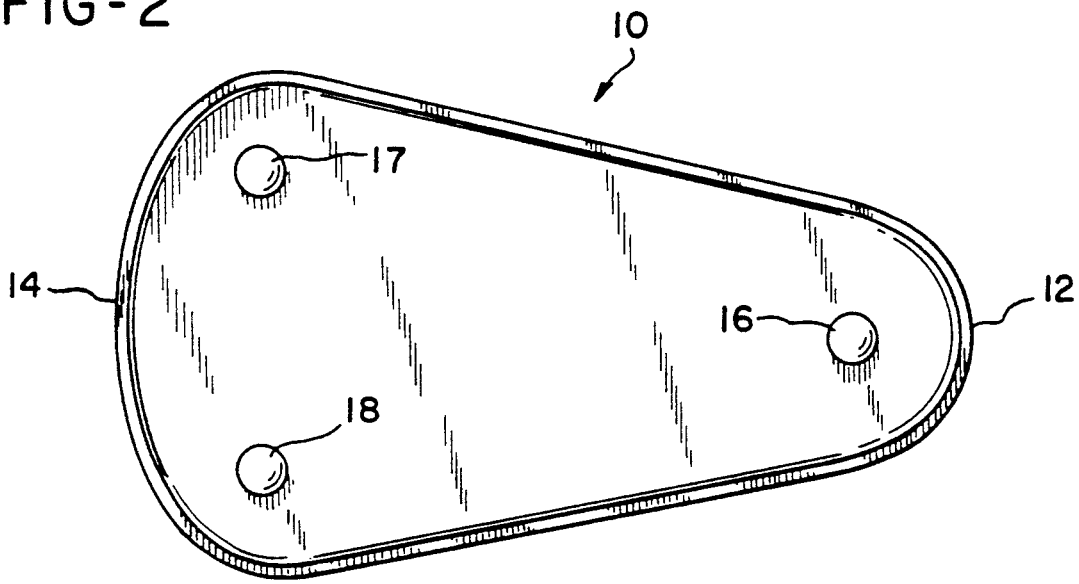
FIG. 2 is a bottom view thereof.

FIG. 1 illustrates a support 10 of the present invention having a forward end portion 12 and a rear end portion 14. The support 10 of the present invention is supported at three points by three rolling elements 16, 17 and 18 held within suitable supports to enable the support 10 to be slid along a horizontal surface into any desired position.

As illustrated in FIG. 1, the forward portion 12 is supported at a declination to the rearward portion 14. It is intended that a forearm can be positioned lenghtwise along the support 10 with the forward portion of the forearm of the user position at the forward portion 12 with the wrist of the user extending forwardly from the forward portion 12 of the support 10.

Figure 3:
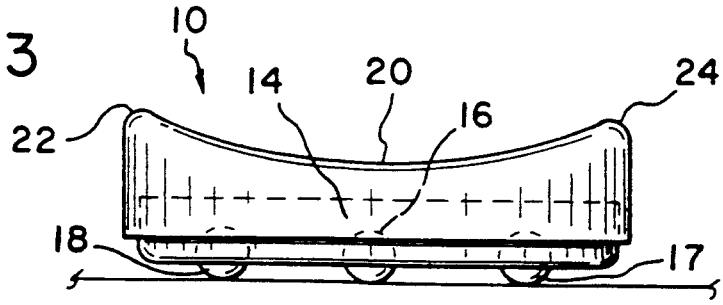
FIG. 3 is an end view thereof from the left of FIG. 1.

As can be seen in FIG. 3, the central portion of the support is concave substantially along its length to provide depression 20 with respective upstanding portions 22 and 24 positioned at the lateral portions of the support 10. A fabric covering may be provided with subitable padding to cushion the forearm of the user.

In this way, with the forearm of the user positioned within the depression 20, the support can be slid easily on a horizontal surface by simple actuation of the forearm without the need for any overstraps or the like. It has been found that the use of this simple depression to enable the user to control the support greatly reduces fatigue and enables the user to use such items as a computer mouse for greater periods of time.

My invention is not intended to be limited by the detailed descriptions of the preferred embodiment described above, but by the appended claims.

I claim:

1. A support for the forearm of a person actuating an object slideable along a horizontal surface, including a pad supported at a declination upon rolling elements so as to receive the forward portion of a forearm of the person actuating said object at its lower end, said pad having a concave central portion rising upwardly at its lateral portions so that movement of said forearm of the user can direct the position of said support.

2. A support as set forth in claim 1, wherein said pad having a generally triangular configuration with the forward end thereof being narrower than the rear end and supporting a singular rolling element, the rearward end supporting two rolling elements.

* * * * *